US010820628B2

(12) United States Patent
France

(10) Patent No.: US 10,820,628 B2
(45) Date of Patent: Nov. 3, 2020

(54) CIGAR CUTTER

(71) Applicant: Benchmade Knife Co., Inc., Oregon City, OR (US)

(72) Inventor: Jason France, Oregon City, OR (US)

(73) Assignee: Benchmade Knife Co., Inc., Oregon City, OR (US)

( * ) Notice: Subject to any disclaimer, the term of this patent is extended or adjusted under 35 U.S.C. 154(b) by 0 days.

(21) Appl. No.: 16/440,421

(22) Filed: Jun. 13, 2019

(65) Prior Publication Data

US 2019/0380384 A1 Dec. 19, 2019

Related U.S. Application Data

(60) Provisional application No. 62/686,319, filed on Jun. 18, 2018.

(51) Int. Cl.
*A24F 13/26* (2006.01)

(52) U.S. Cl.
CPC ..... *A24F 13/26* (2013.01)

(58) Field of Classification Search
CPC ..... A24F 13/26
USPC ..... 30/155–161, 111–121
See application file for complete search history.

(56) References Cited

U.S. PATENT DOCUMENTS 1,728,992 A * 9/1929 Frank ..... A24F 13/26 30/156
1,782,901 A * 11/1930 Kassel ..... B26B 5/006 30/156
1,969,752 A * 8/1934 Holtzman ..... B26B 5/006 30/156
2,523,575 A * 9/1950 Kassel ..... A24F 13/26 30/156
5,937,523 A 8/1999 Van Keppel et al.
RE41,259 E 4/2010 McHenry et al.
7,770,295 B2 8/2010 Smith
D630,794 S 1/2011 Cohen Harel
8,171,645 B2 * 5/2012 Duey ..... B26B 1/048 30/159
8,939,054 B2 * 1/2015 Hawk ..... B26B 1/04 30/151
9,119,422 B2 9/2015 Lance et al.
D758,005 S 5/2016 Lance et al.
D758,006 S 5/2016 Shukla
2005/0144788 A1 * 7/2005 Lake ..... B26B 1/046 30/160
2005/0223562 A1 * 10/2005 Pardue ..... B26B 1/046 30/161
2007/0089299 A1 4/2007 Belaubre
2009/0113719 A1 5/2009 Smith
2010/0257741 A1 10/2010 Lin et al.
2014/0082945 A1 3/2014 Lance et al.
(Continued)

*Primary Examiner* — Hwei-Siu C Payer
(74) *Attorney, Agent, or Firm* — Schwabe Williamson & Wyatt, P.C.

(57) ABSTRACT

A cigar cutter having a handle with a transverse cigar hole and a cutting blade configured to cut a cigar tip placed in the cigar hole. The cutting blade having a central lock portion and pivotally connected to the rear end of the handle by a pivot shaft. The cigar cutter further having a lock bar that is movable between a first position and a second position, wherein the first position locks the cutting blade when in a closed position, and moving the lock bar to the second position releases the cutting blade from being locked in the closed position.

11 Claims, 13 Drawing Sheets

(56) References Cited

U.S. PATENT DOCUMENTS

| | | | | |
|---|---|---|---|---|
| 2016/0067871 | A1* | 3/2016 | Onion | B26B 1/02 30/158 |
| 2016/0121493 | A1* | 5/2016 | Ikoma | B26B 1/048 30/161 |
| 2019/0380384 | A1* | 12/2019 | France | A24F 13/26 |

* cited by examiner

CIGAR CUTTER

TECHNICAL FIELD

This application claims the priority benefit of the earlier filing date of U.S. Provisional Application No. 62/686,319, filed Jun. 18, 2018, which is incorporated herein by reference in its entirety.

TECHNICAL FIELD

The present disclosure relates to cigar cutters, and more particularly, to a cigar cutter having a locking mechanism to lock a blade of the cigar cutter in a closed position.

BACKGROUND

A cigar is a tightly-rolled bundle of dried and fermented tobacco that is ignited so that its smoke may be drawn into the mouth. A typical premium cigar is constructed with three layers of tobacco: filler, binder and wrapper. Most quality handmade cigars, regardless of shape, will have a cap. The cap is one or more small pieces of a wrapper pasted onto one end of the cigar. Typically the cap end of a cigar is rounded, and a portion of this cap must be removed to smoke the cigar. In order to remove a portion of the cap, the cap is typically cut with a blade, such as with a blade of a knife or cigar cutter. A cigar cutter is a mechanical device designed to cut off one or both ends of a cigar so that it may be properly smoked. Most have at least one blade made of steel. If the cap is cut jaggedly or without proper care, problems with the smokeability of the cigar can result. For example, the end of the cigar may not burn evenly, smokeable tobacco could be lost, the draw (the term commonly used to describe how easily a cigar allows air to pass through it) could be adversely affected and/or the outer wrapper may unravel. In some cases, improperly cutting the cap can render a cigar effectively unsmokeable. Thus, the need exists for quality cigar cutters.

BRIEF DESCRIPTION OF THE DRAWINGS

Embodiments will be readily understood by the following detailed description in conjunction with the accompanying drawings and the appended claims. Embodiments are illustrated by way of example and not by way of limitation in the figures of the accompanying drawings.

DETAILED DESCRIPTION OF DISCLOSED EMBODIMENTS

Figure 1:
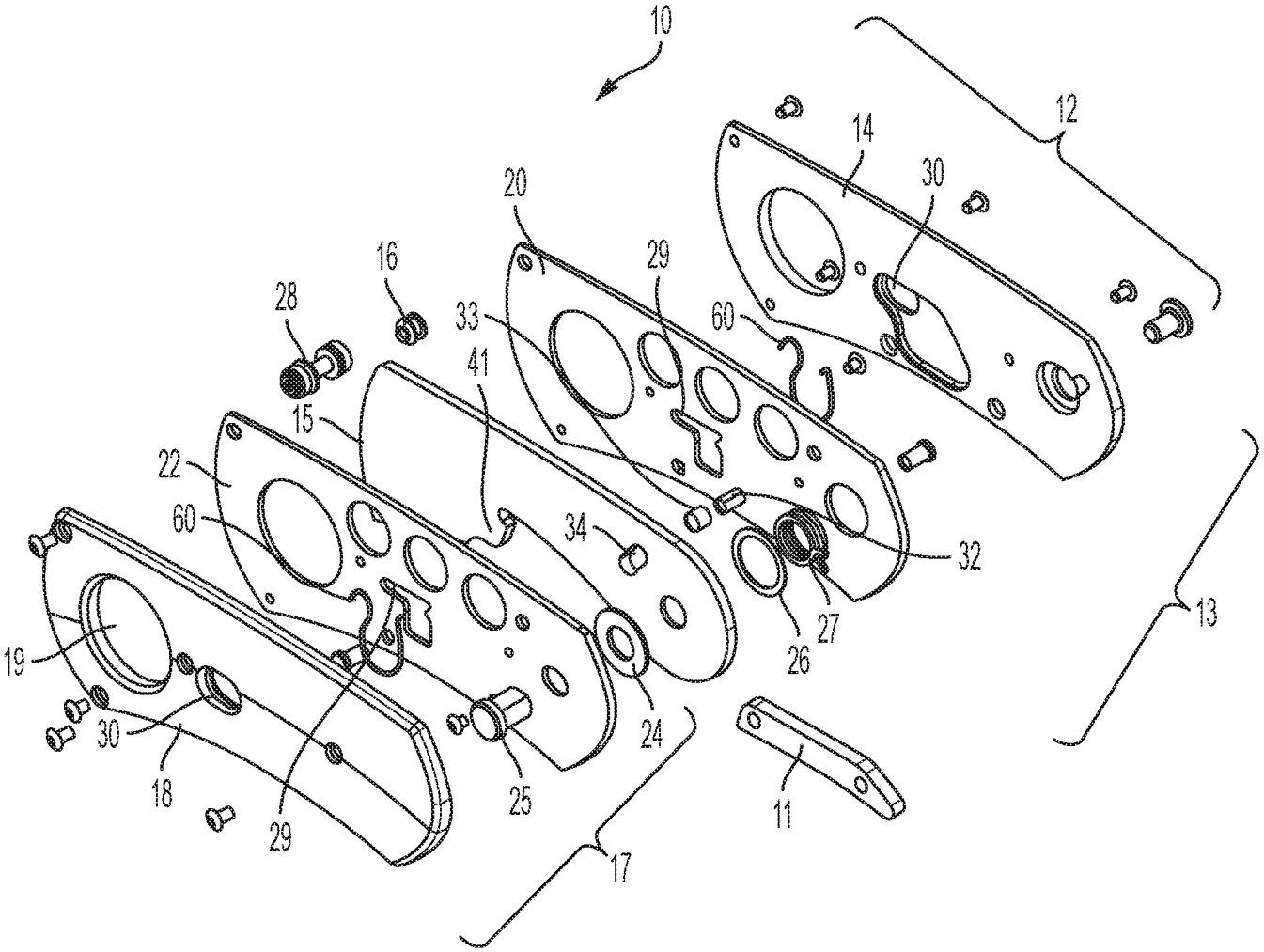
FIG. 1 is a perspective and exploded view of a cigar cutter, in accordance with various embodiments.

In the following detailed description, reference is made to the accompanying drawings, which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical contact with each other. "Coupled" may mean that two or more elements are in direct physical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

The present disclosure relates to a cigar cutter having a handle and a cutting blade that is configured to cut a cigar and/or cigar tip that is placed in a cigar hole that runs transverse to a long axis of the handle. The cigar hole is located toward the front end of the handle. The disclosed cigar cutter includes a blade lock mechanism that locks the cutting blade in a close and safe position, for example such that the cigar cutter may be carried in a pocket without fear of cutting either the material of the pocket or the user as they retrieve the cigar cutter from their pocket or other location. As disclosed herein, the blade lock mechanism must be actively actuated to open the cigar cutter, providing a measure of safety from unintended opening of the blade.

In embodiments, a disclosed cigar cutter, such as a folding cigar cutter, includes a handle having a first handle half and a second handle half held in a spaced apart relationship from each other to form a blade groove therebetween. In certain embodiments, the first handle half and the second handle half each include a sidewall and a liner. The cigar cutter includes a cutting blade having a lower sharpened edge and an upper unsharpened spine. The cutting blade is pivotally connected between the first handle half and the second handle half, for example, by a pivot shaft that spans the blade groove. Typically, a cutting blade has a tang and a working portion. The tang can be thought of as the butt end and is where the cutting blade attaches to the handle halves with the pivot pin. The cutting blade is movable between an open position and closed position. In certain embodiments, movement of the cutting blade is facilitated by placement of a bearing or bushing between the tang of the blade and either or both of the two handle halves, for example a bearing or bushing disposed about the pivot shaft.

The cigar cutter further includes a blade locking mechanism that is configured to lock the blade in the closed position. As discussed above, an important safety feature of the cigar cutter is that this locking mechanism is actively actuated to deploy the blade. In certain embodiments, the blade locking mechanism includes a lock bar that is movable between a first position and a second position, wherein the first position locks the cutting blade in a closed position, and moving the lock bar to the second position releases the cutting blade from being locked in the closed position. In embodiments, the lock bar is biased to the locked position, for example using one or more springs.

One of the unique features of the disclosed cigar cutter is the configuration of the cutting blade. In embodiments, the cutting blade has a front end, a rear end, and a central lock portion disposed between the front end and the rear end. This central lock portion of the cutting blade is configured to interact with the lock bar to provide a mechanism that automatically locks the cutting blade in a closed position when the blade is closed by a user. In addition, this central lock portion of the cutting blade works with the lock bar to hold the blade in the locked position until a user moves the locking bar from the first position to the second position. In embodiments, the central lock portion of the cutting blade is centrally located within the body of the cutting blade between the spine and a line extending from the sharpened portion of the cutting blade, for example inset within the body portion of the cutting blade. In embodiments, the central lock portion of the cutting blade includes a ramped portion that is configured to contact the lock bar as the blade is moved from an open position to a closed position. As the cutting blade is moved from the open position to the closed position, this ramped portion of the central locking portion comes in contact with the lock bar, for example, when the cigar cutter is being used to cut a cigar. As the cutting blade is moved further toward the closed position eventually the ramped portion of the central lock portion ends at a central lock tip. In embodiments, the central look portion of the cutting blade comprises the central lock tip disposed between the ramped portion and central blade retention slot. In embodiments, the central lock tip is configured to separate the cutting blade from the locked position and the unlocked position. As the lock bar passes over this central lock tip, it is pushed forward (e.g. biased) into a central blade retention slot where it now locks the cutting blade in the closed position. In embodiments, the lock bar is biased to the first position by one or more biasing members, such as springs. Once the lock bar is in the central blade retention slot, backward pressure must be supplied, for example, by a user, to release the cutting blade from the locked position. In embodiments, the central lock portion is disposed on a sharpened side of the cutting blade.

In embodiments, the cigar cutter also includes a blade stop mechanism that effectively limits the travel of the cutting blade when the locking mechanism is disengaged. This feature is especially important for a cigar cutter for both functionality and safety. In such embodiments, the sharpened portion of the cutting blade is prevented from being exposed to a user. The only place the sharpened portion of the blade is visible is when the cutting blade is in the unlocked position and ready for insertion of a cigar tip. In embodiments, the cigar cutter includes an open position stop. In embodiments, a stop pin is disposed between the first handle half and the second handle half and residing in a blade stop slot, and wherein the open position stop pin and blade stop slot are configured to prevent the blade from fully opening to expose a sharpened blade edge.

With reference now to the drawings, a cigar cutter 10 having a cutting blade as disclosed is illustrated in FIGS. 1 through 5. The cigar cutter 10 includes a blade locking system that locks the blade in the closed position.

The cigar cutter 10 according to the present disclosure is shown in perspective exploded view in FIG. 1. With reference to FIG. 1, the folding cigar cutter 10 includes an elongate handle 12 that includes a first handle half 13 having a first sidewall 14 and an associated first liner 20 and a second handle half 17 having a second sidewall 18 with an associated second liner 22. The handle further includes a spacer block 11 and spacer nut 16 disposed within handle 12 to help separate the handle halves. A cutting blade 15 is pivotally attached to the handle 12 between the first handle half 13 and the second handle half 17 at one end, referred to herein as the "rear" or "butt" end of the handle 12. Other relative directional terms correspond to this convention: the "forward" end of the handle 12 is opposite the rear end; the "upper" or spine part of a blade is the dull, non-working portion and the "lower" part of the blade is the sharpened, working portion; "inner" or "inward" refers to the structural center of the cigar cutter, and so on. The X-Y plane is the plane parallel to the plane of the handle 12 and cutting blade 15. The cutting blade 15 travels in the X-Y plane as it is rotated between the closed and open positions. The Z plane is the plane transverse to the X-Y plane. For example, a blade pivot pin 25 extends longitudinally in the Z-plane and transverse to the X-Y plane. The cutting blade 15 is pivotally movable about the blade pivot pin 25 between the open and closed positions along a blade plane (X-Y plane). To allow for smooth movement of the cutting blade 15, washers or bushings 24 and 26 may be disposed between the cutting blade 15 and the liners 20 and 22 about the pivot pin 25. The blade 15 is biased into the open position by a spring 27 disposed about the pivot pin 25 and is coupled to the handle 12 at one end of the spring 27 and the cutting blade 15 at the other end of the spring 27. Tension is applied to the spring 27 when the cutting blade 15 is moved from the open to closed position. When the cutting blade 15 is unlocked (as described below) the cutting blade 15 is rotated to its open position by the force of the spring 27. Disposed in the forward end of the handle 12 is a cigar hole 19. The cigar hole 19 extends all the way through the handle, i.e. through the first sidewall 14 and associated first liner 20 and the second sidewall 18 and associated second liner 22, and thus can be used as either a left handed or right handed cigar cutter. The cigar hole is configured to allow the end of a cigar to pass into and through the handle 12 when the cutting blade 15 is in the open position. When the cutting blade 15 is moved from the open position to the closed position, the cutting blade 15 would cut a cigar or cigar tip placed in the cigar hole 19.

Figure 2A:
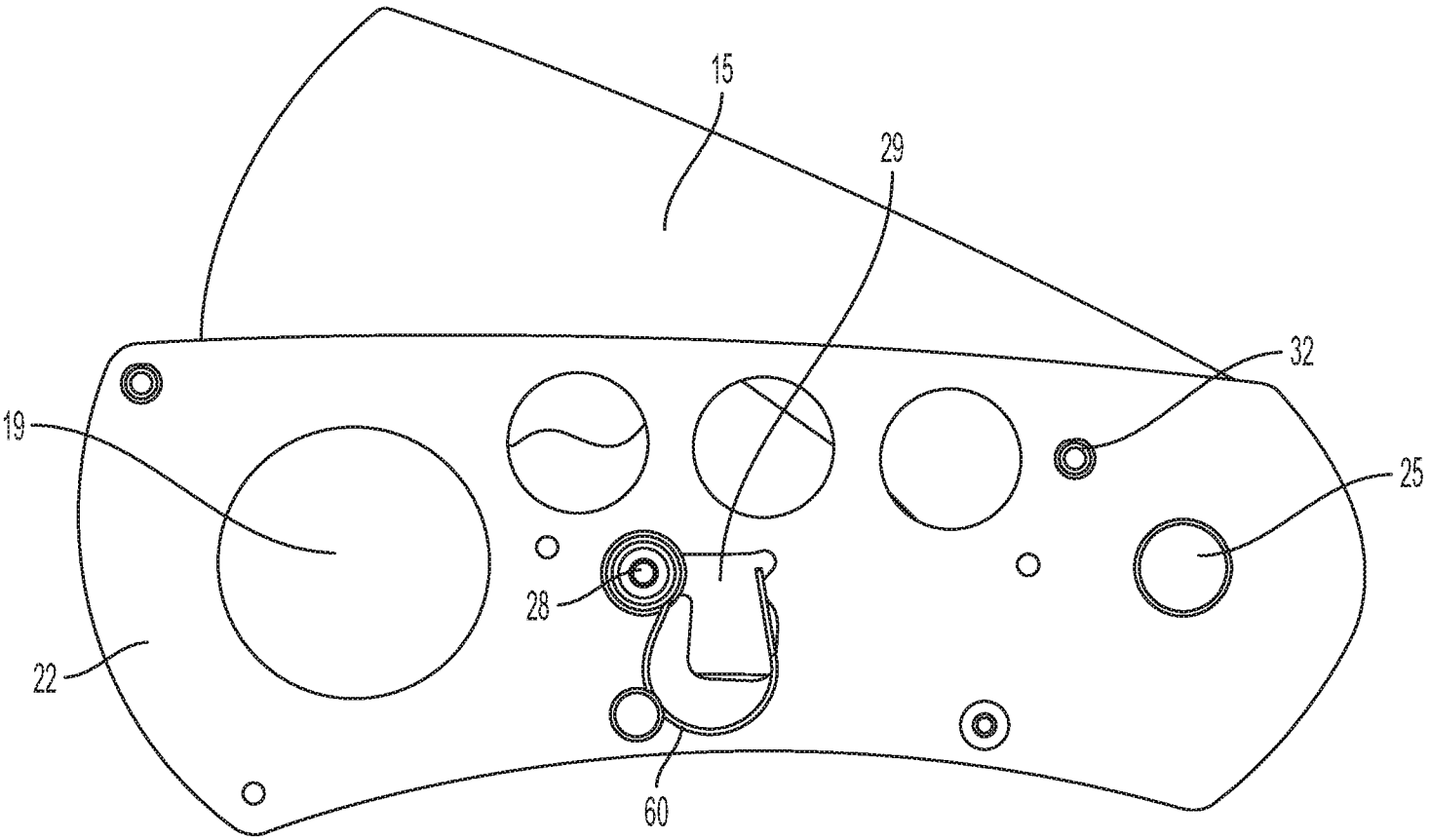
FIG. 2A is a left side elevation view of the cigar cutter shown in FIG. 1 in an assembled condition with the blade in an open position with the sidewalls omitted for clarity, in accordance with various embodiments.
Figure 2B:
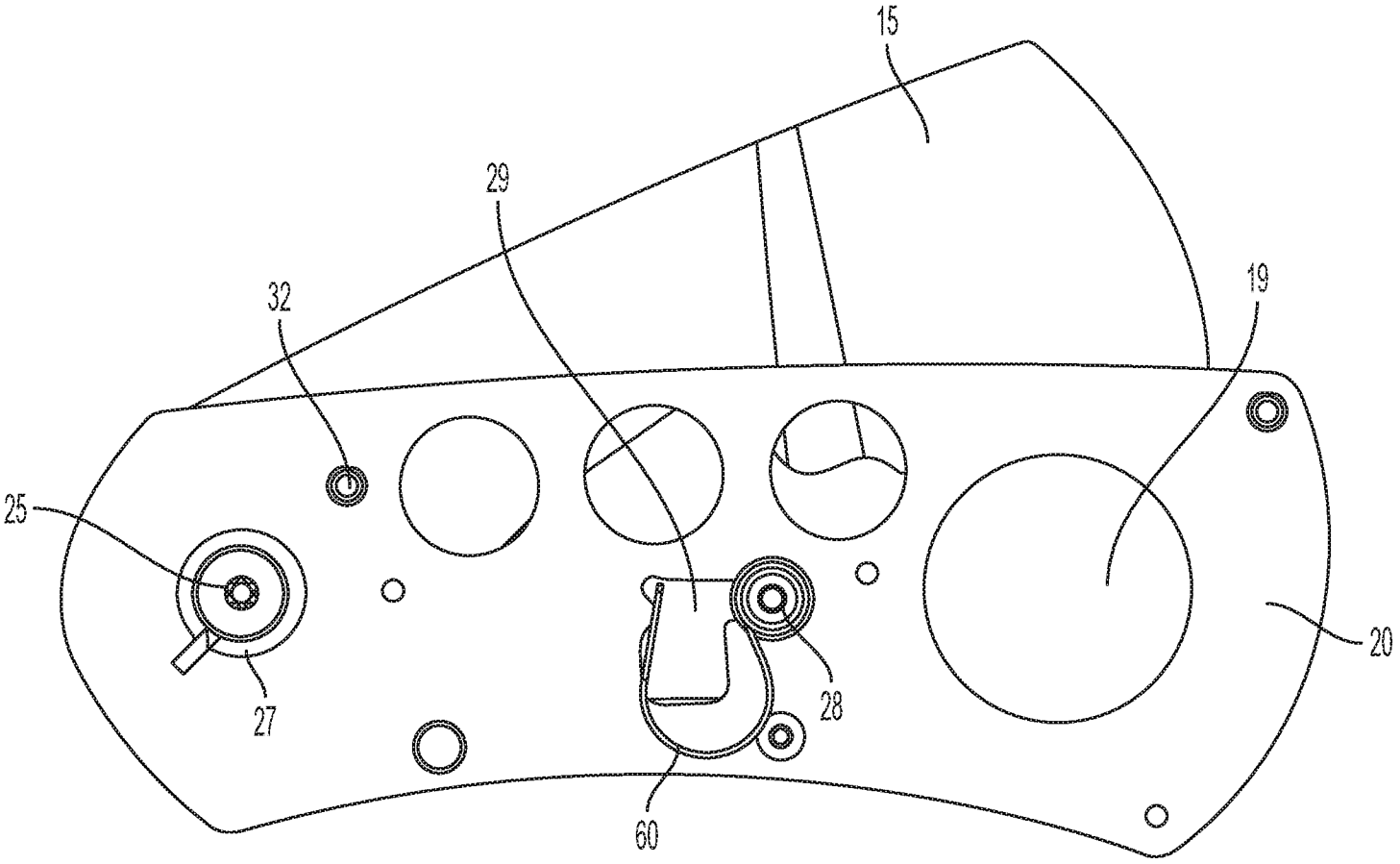
FIG. 2B is a right side elevation view of the cigar cutter shown in FIG. 1 in an assembled condition with the blade in an open position with the sidewalls omitted for clarity, in accordance with various embodiments.
Figure 3A:
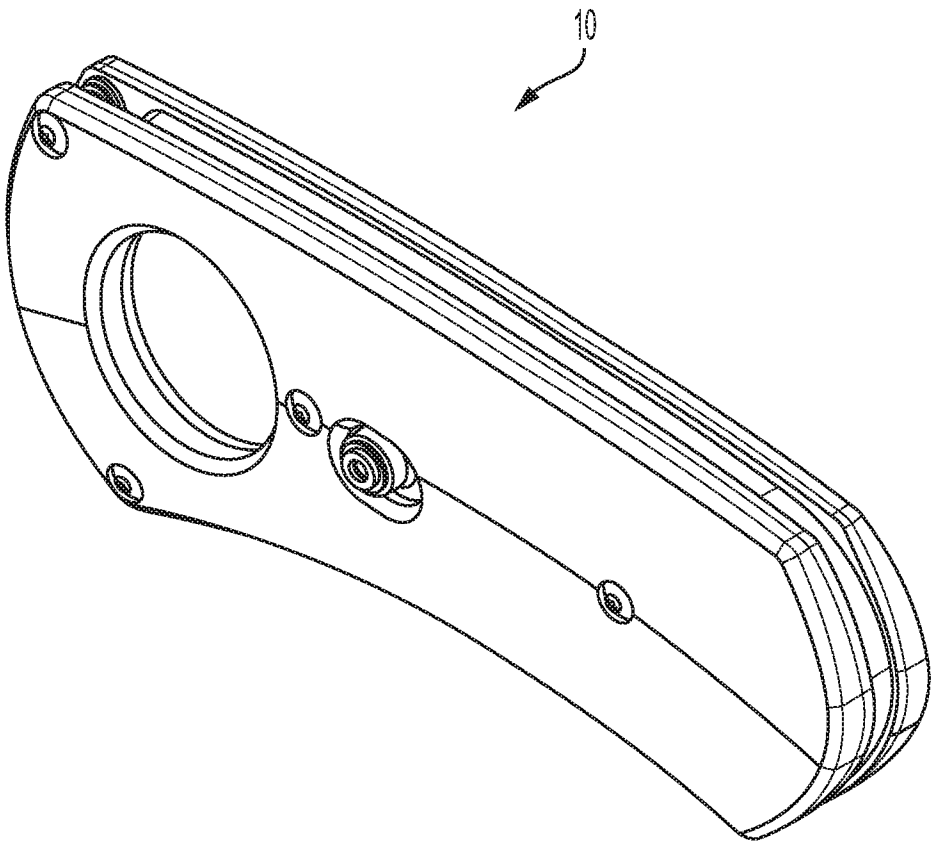
FIG. 3A is a perspective view of the cigar cutter shown in FIG. 1 in an assembled condition with the blade in a closed position, in accordance with various embodiments.
Figure 3B:
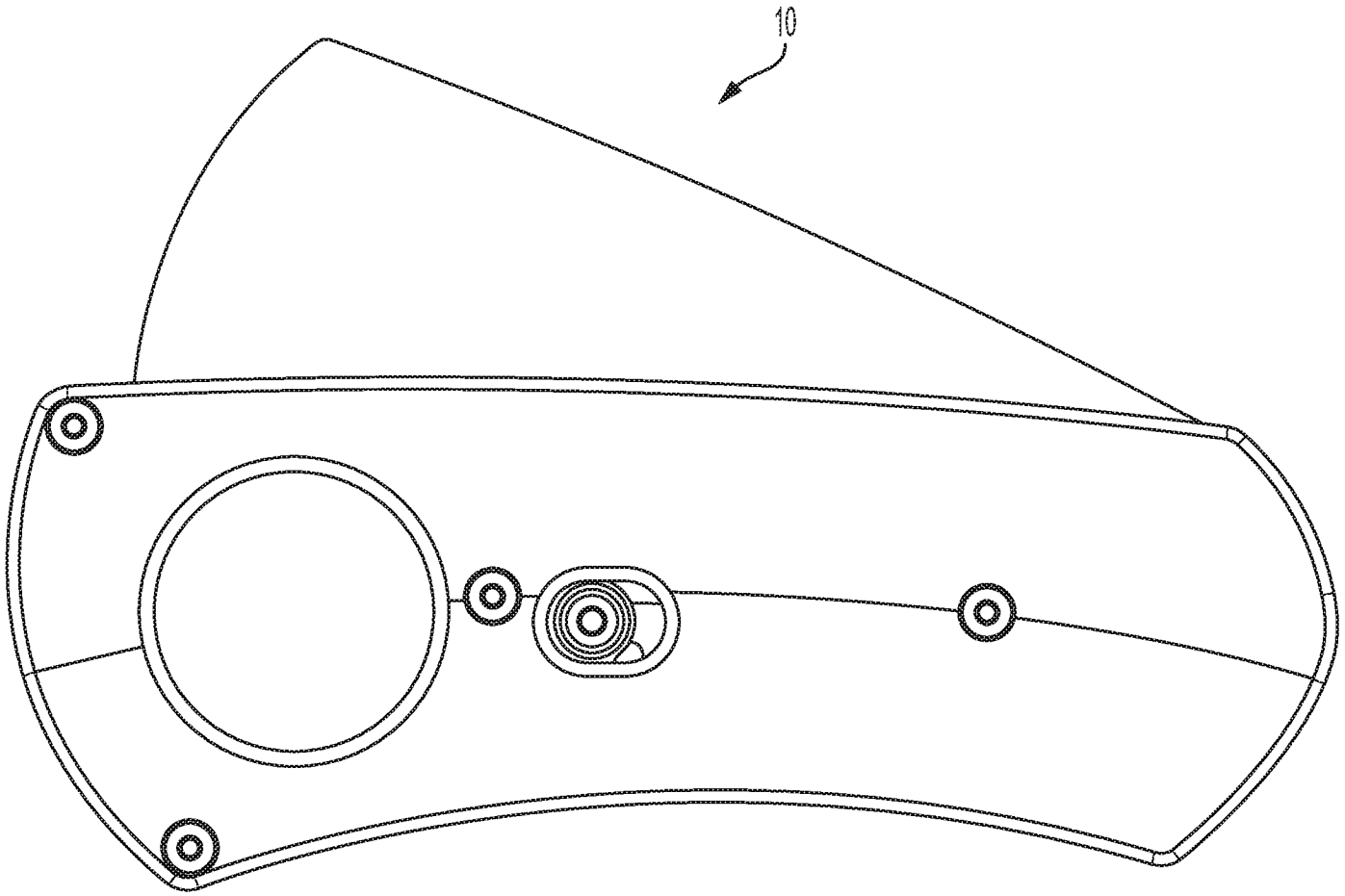
FIG. 3B is a left side elevation view of the cigar cutter shown in FIG. 1 in an assembled condition with the blade in an open position, in accordance with various embodiments.
Figure 3C:
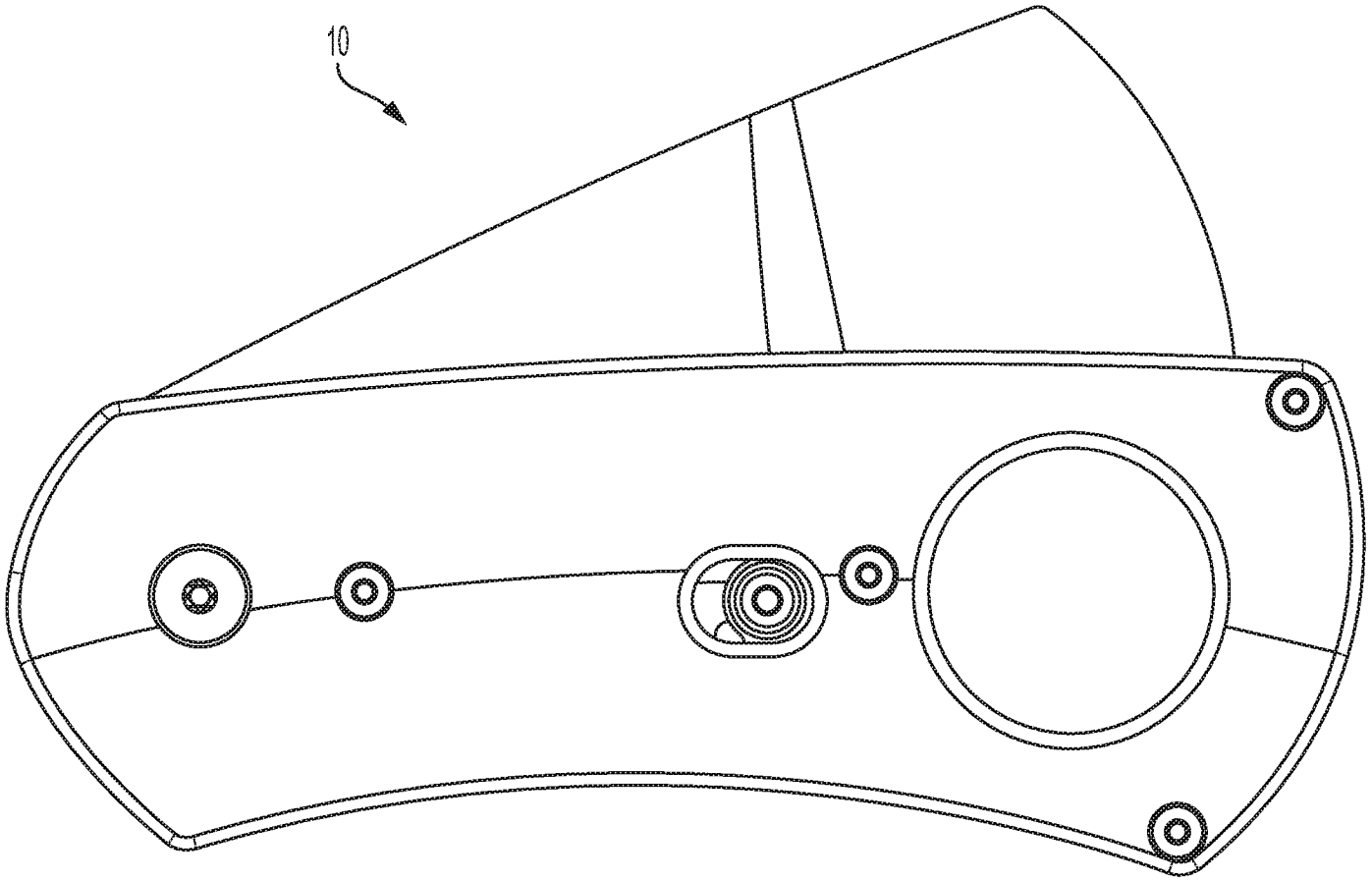
FIG. 3C is a right side elevation view of the cigar cutter shown in FIG. 1 in an assembled condition with the blade in an open position, in accordance with various embodiments.
Figure 3D:
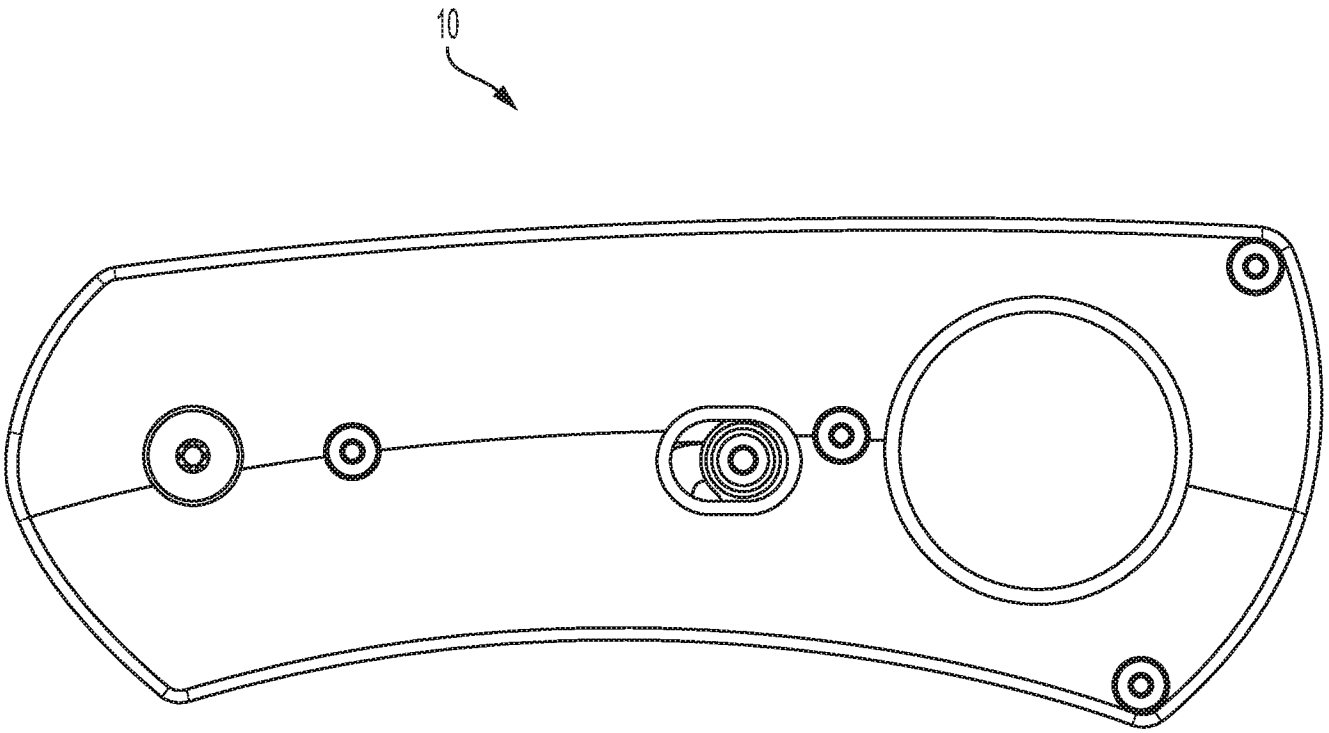
FIG. 3D is a right side elevation view of the cigar cutter shown in FIG. 1 in an assembled condition with the blade in a closed position, in accordance with various embodiments.
Figure 3E:
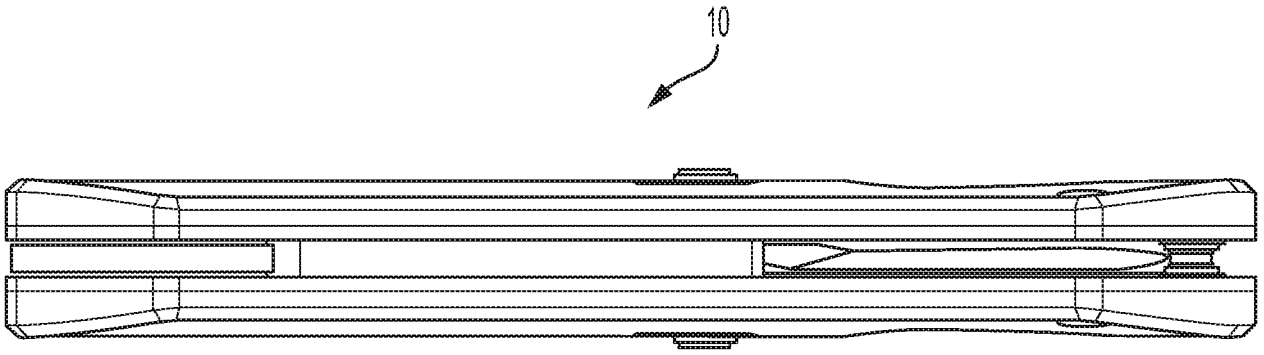
FIG. 3E is a bottom view of the cigar cutter shown in FIG. 1 in an assembled condition with the blade in a closed position, in accordance with various embodiments.
Figure 3F:
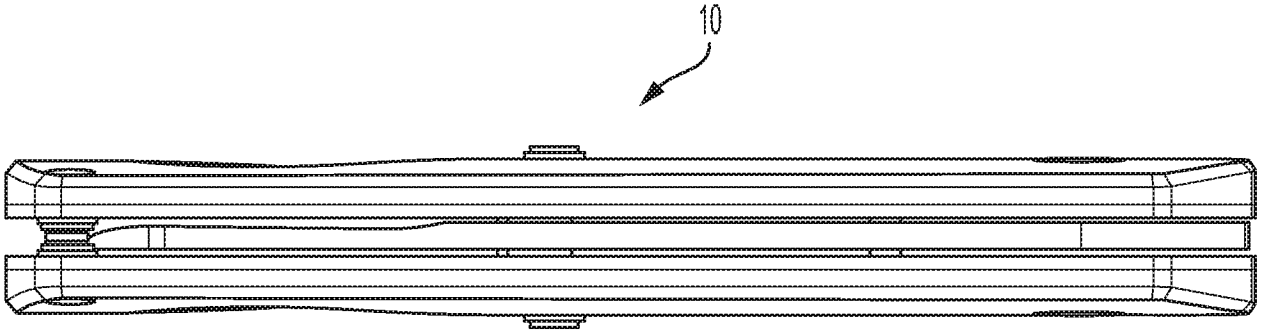
FIG. 3F is a top view of the cigar cutter shown in FIG. 1 in an assembled condition with the blade in a closed position, in accordance with various embodiments.
Figure 3H:
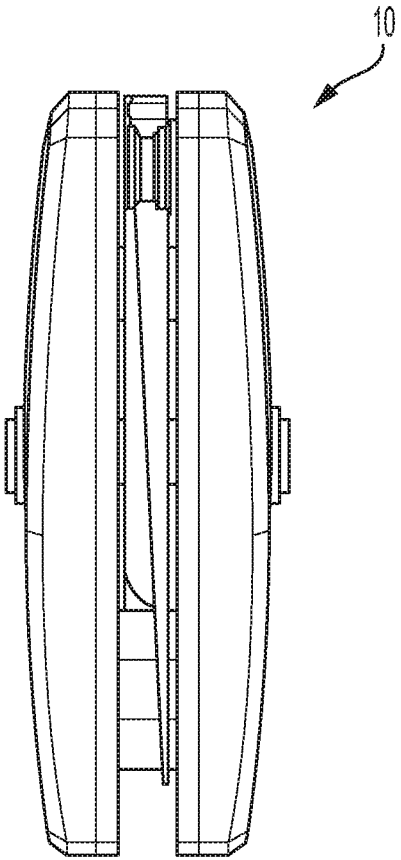
FIG. 3H is a front view of the cigar cutter shown in FIG. 1 in an assembled condition with the blade in a closed position, in accordance with various embodiments.
Figure 3G:
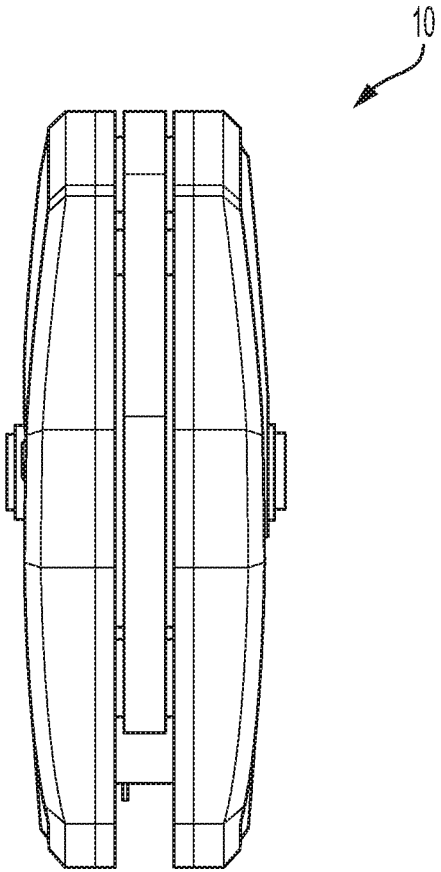
FIG. 3G is a rear view of the cigar cutter shown in FIG. 1 in an assembled condition with the blade in a closed position, in accordance with various embodiments.

As best shown in FIGS. 2A and 2B, the locking mechanism of the cigar cutter 10 includes a lock bar 28 that extends transverse to the plane of the handle 12 and which has its opposite ends extending in slots 30 in sidewalls 14 and 18, which align operationally with paired slots 29 in liners 20 and 22. The lock bar 28 may be spring loaded or biased with two U or horseshoe-shaped lock springs 60, one such spring associated with each of liners 20 and 22 and positioned between the sidewalls 14 and 18 and their associated, adjacent liners 20 and 22. A first end of each lock spring 60 is fixed to the associated liner and the second end of the lock spring 60 is attached to the lock bar 28 so that the lock bar 28 is always driven in the "forward" direction by the springs 60. The lock bar 28 and the springs 60 that act on the lock bar 28 lock the cutting blade 15 in the closed position, for example as shown in U.S. Pat. No. RE 41,259. When the cutting blade 15 is in the closed position, the lock bar 28 is driven forward and interacts with a central locking portion 41 of the cutting blade 15 to lock the cutting blade 15 closed. The cigar cutter 10 further includes an open blade stop pin 32 and bushing 33 that stops rotation of the cutting blade 15. The open blade stop pin 32 and bushing 33 are disposed between the handle halves 13 and 17 and resides within a slot 34.

Several views of the cigar cutter 10 fully assembled are shown in FIGS. 3A-3H.

Figure 4A:
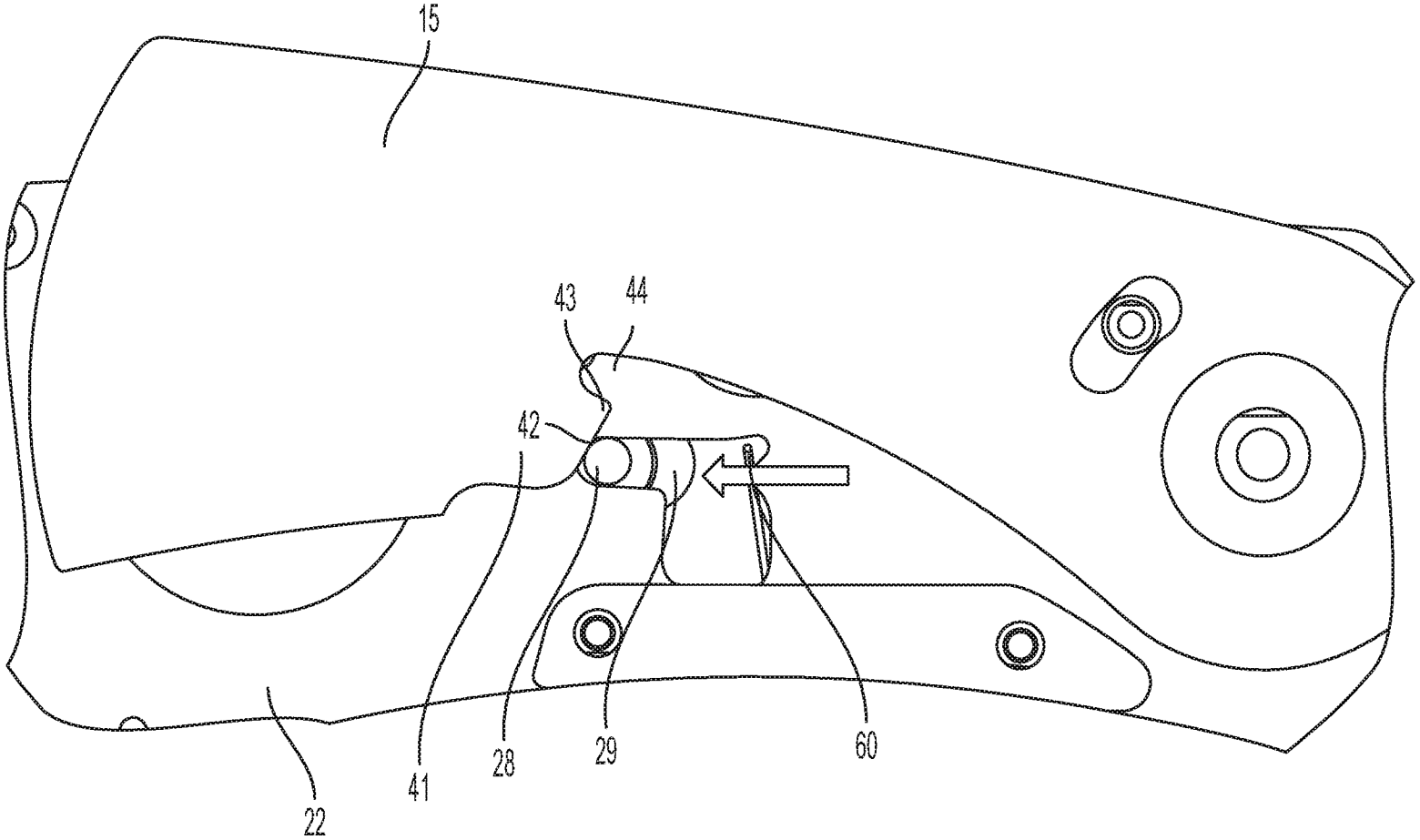
FIGS. 4A, 4B, and 4C are a sequential series of side elevation views showing the operation of the blade locking mechanism of the cigar cutter shown in FIG. 1, in accordance with various embodiments.
Figure 4B:
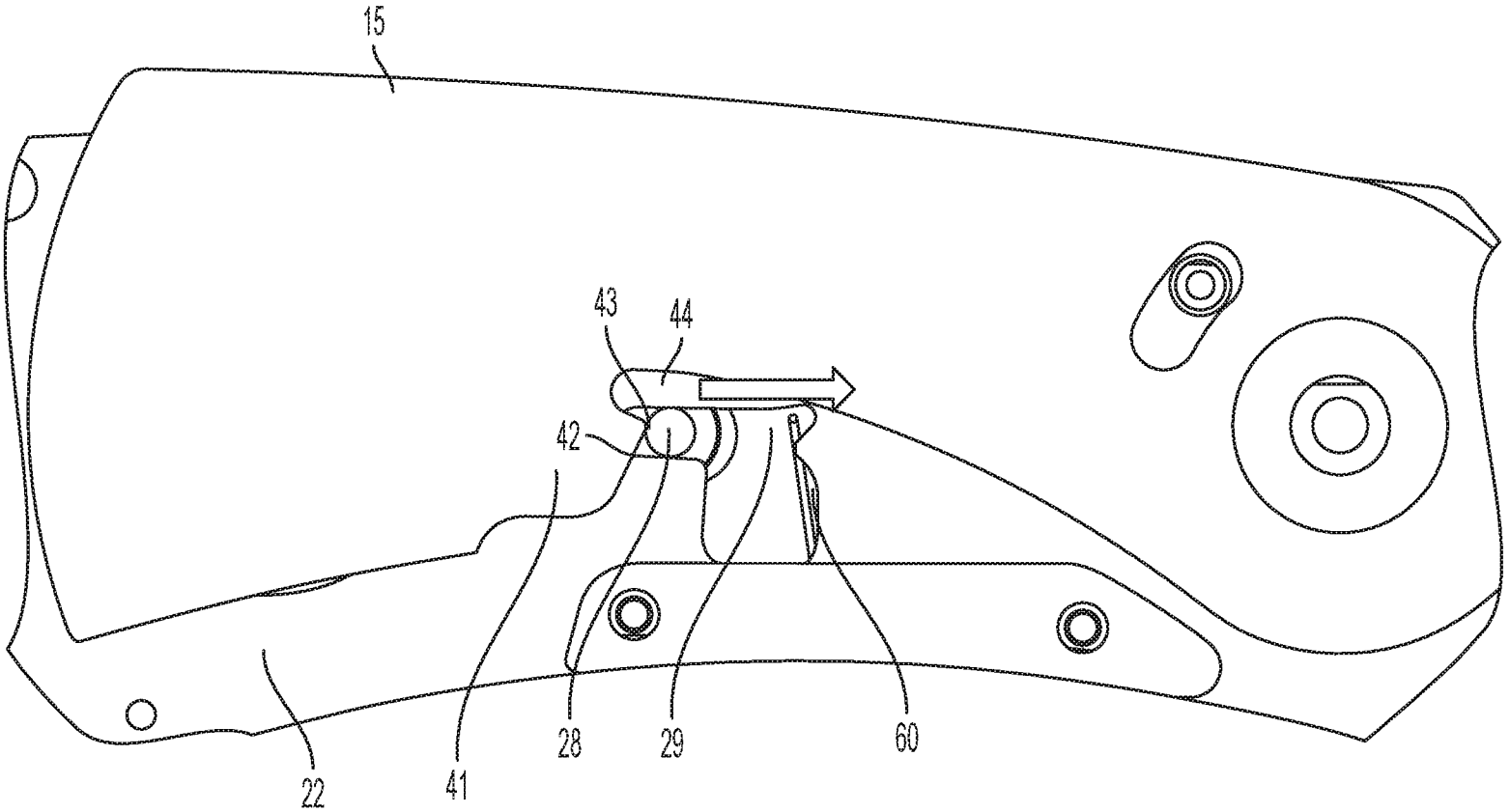
Figure 4C:
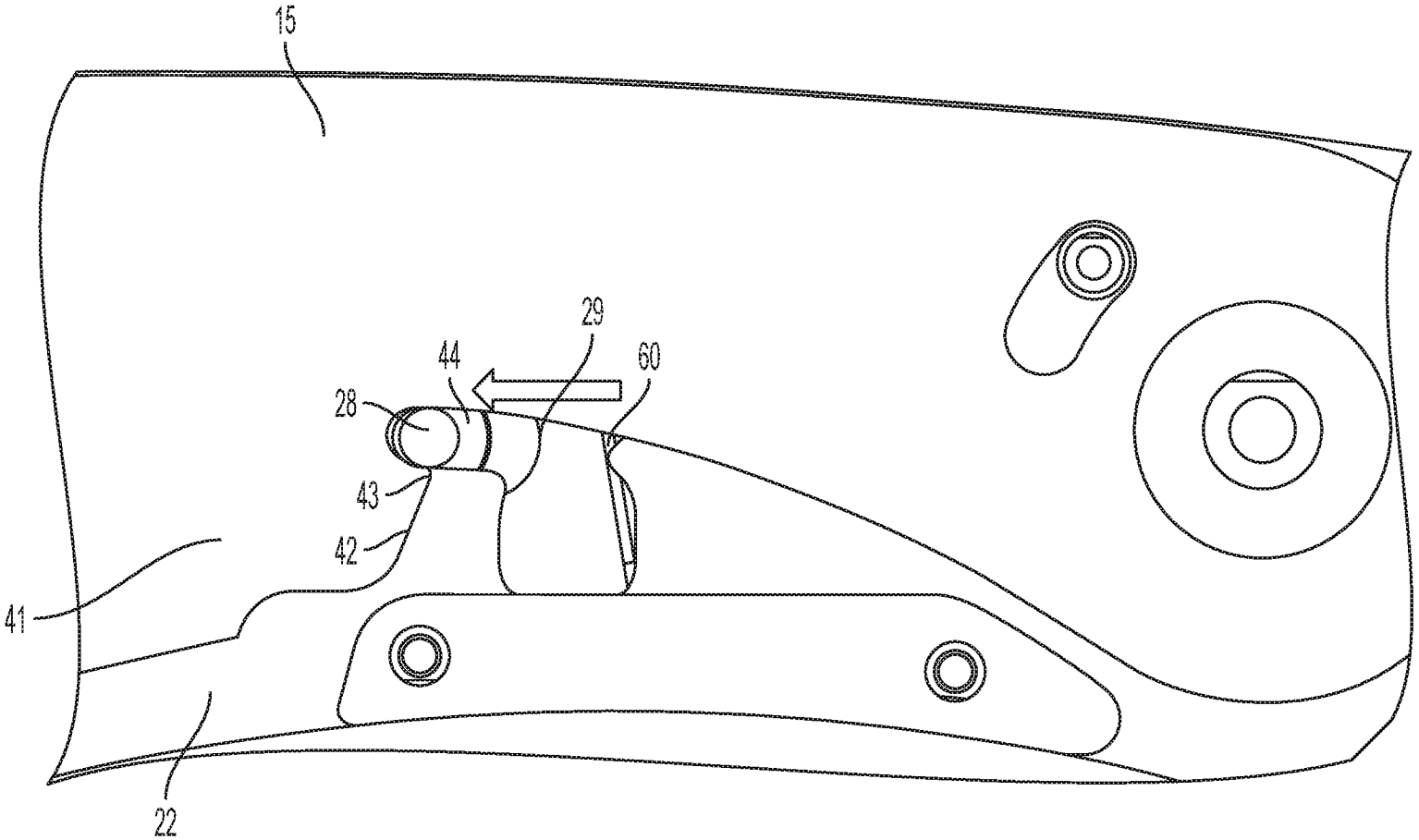

FIGS. 4A-4C show side elevation views of the cigar cutter 10, focusing on the blade lock mechanism, with one handle half removed for clarity and showing the sequential action of the locking mechanism as the cutting blade 15 is moved into the fully closed position. The timing and dimensionality of the mechanism provides for precision closing of the cutting blade 15. Referring to FIG. 4A, the blade lock includes the locking bar 28 and a central locking portion 41 of the cutting blade 15. As the cutting blade 15 is moved toward the closed position, for example, as a cigar is cut, a ramped portion 42 of the central locking portion 41 comes in contact with the lock bar 28 which is biased toward the front of the cigar cutter 10 in the direction of the arrow. Turning to FIG. 4B, the locking bar 28 is driven back in the slot 29 against the pressure exerted by spring 60 in the direction of the arrow until the lock bar 28 reaches a tipping point and rolls over a central lock tip 43. Turning to FIG. 4C, once the tipping point is reached, the lock bar 28 is driven forward in the slot 29 by the spring 60 and into a central blade retention slot 44, located on a central portion of the blade 15. Once in the central blade retention slot 44, backward pressure must be supplied, for example, by a user, to release the blade to cut another cigar.

Figure 5:
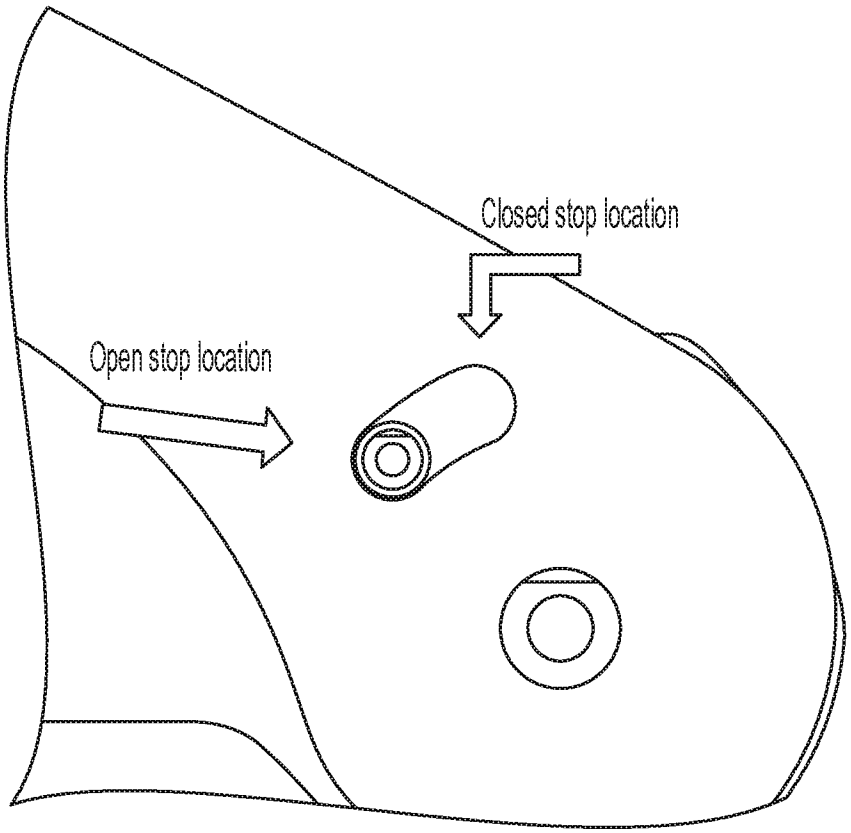
FIG. 5 is a side elevation view showing the operation of the blade stop pin of the cigar cutter shown in FIG. 1, in accordance with various embodiments.

FIG. 5 is a side elevation view of the cigar cutter 10 showing how the blade stop pin stops the blade from opening beyond a predetermined degree of rotation.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

The invention claimed is:

1. A cigar cutter comprising:

a handle having a front end and a rear end, the front end having a transverse cigar hole disposed therein, the handle comprising a first handle half and a second handle half and held in a spaced apart relationship to form a blade groove therebetween;

a cutting blade having a front end, a rear end, and a central lock portion disposed between the front end of the blade and the rear end of the blade, the rear end of the cutting blade disposed between the first handle half and the second handle half and pivotally connected to the rear end of the handle by a pivot shaft; and a lock bar that is movable between a first position and a second position, wherein the first position locks the cutting blade when in a closed position, and moving the lock bar to the second position releases the cutting blade from being locked in the closed position, wherein the central lock portion of the cutting blade comprises a ramped portion configured to contact the lock bar as the cutting blade is moved from an open position to the closed position.

2. The cigar cutter of claim 1, wherein the ramped portion pushes the lock bar backward as the cutting blade is moved from the open position to the closed position.

3. The cigar cutter of claim 1, wherein the central lock portion of the cutting blade comprises a central blade retention slot into which the lock bar is driven when the cutting blade is in the closed position.

4. The cigar cutter of claim 1, wherein the central lock portion of the cutting blade comprises a central lock tip disposed between the ramped portion and a central blade retention slot of the cutting blade.

5. The cigar cutter of claim 1, wherein the central lock portion is disposed on a sharpened side of the cutting blade.

6. The cigar cutter of claim 1, wherein the first handle half and the second handle half each comprise a sidewall and a liner.

7. The cigar cutter of claim 1, wherein the lock bar is biased to the first position by one or more springs.

8. The cigar cutter of claim 1, wherein the cutting blade is biased toward the open position with one or more springs.

9. The cigar cutter of claim 1, further comprising an open position stop configured to stop a sharpened portion of the blade from opening beyond the handle.

10. The cigar cutter of claim 9, wherein the open position stop comprises a stop pin disposed between the first handle half and the second handle half and residing in a blade stop slot disposed in the cutting blade, and wherein the stop pin and the blade stop slot are configured to prevent the blade from opening beyond the handle.

11. A cigar cutter comprising:

a handle having a front end and a rear end, the front end having a transverse cigar hole disposed therein, the handle comprising a first handle half and a second handle half and held in a spaced apart relationship to form a blade groove therebetween;

a cutting blade having a front end, a rear end, and a central lock portion disposed between the front end of the blade and the rear end of the blade, the rear end of the cutting blade disposed between the first handle half and the second handle half and pivotally connected to the rear end of the handle by a pivot shaft;

a lock bar that is movable between a first position and a second position, wherein the first position locks the cutting blade when in a closed position, and moving the lock bar to the second position releases the cutting blade from being locked in the closed position; and an open position stop configured to stop a sharpened portion of the blade from opening beyond the handle, wherein the open position stop comprises a stop pin disposed between the first handle half and the second handle half and residing in a blade stop slot disposed in the cutting blade, and wherein the stop pin and the blade stop slot are configured to prevent the blade from opening beyond the handle.

* * * * *